US009945231B2

(12) United States Patent
Haugaard et al.

(10) Patent No.: US 9,945,231 B2
(45) Date of Patent: Apr. 17, 2018

(54) HYDRAULIC VANE-TYPE MACHINE

(71) Applicant: Danfoss A/S, Nordborg (DK)

(72) Inventors: Erik Haugaard, Graasten (DK); Hans Christian Petersen, Nordborg (DK)

(73) Assignee: Danfoss A/S, Nordborg (DK)

( * ) Notice: Subject to any disclaimer, the term of this patent is extended or adjusted under 35 U.S.C. 154(b) by 177 days.

(21) Appl. No.: 14/930,720

(22) Filed: Nov. 3, 2015

(65) Prior Publication Data

US 2016/0138398 A1 May 19, 2016

(30) Foreign Application Priority Data

Nov. 14, 2014 (EP) ..... 14193256

(51) Int. Cl.

| | |
|---|---|
| ***F01C 1/344*** | (2006.01) |
| ***F04C 2/344*** | (2006.01) |
| ***F04C 14/06*** | (2006.01) |
| ***F01C 21/08*** | (2006.01) |
| ***F01C 21/10*** | (2006.01) |
| ***F04C 18/344*** | (2006.01) |

(52) U.S. Cl.

CPC ..... *F01C 21/0809* (2013.01); *F01C 1/3448* (2013.01); *F01C 21/0836* (2013.01); *F01C 21/106* (2013.01); *F04C 2/3446* (2013.01); *F04C 2/3448* (2013.01); *F04C 18/3448* (2013.01)

(58) Field of Classification Search

CPC .. F01C 1/3448; F01C 21/0836; F01C 21/106; F04C 18/3448; F04C 2/3448

See application file for complete search history.

(56) References Cited

U.S. PATENT DOCUMENTS

| | | | | |
|---|---|---|---|---|
| 4,454,844 | A | 6/1984 | Kinsey | |
| 6,684,847 | B1 | 2/2004 | Al-Hawaj | |
| 8,347,848 | B2 * | 1/2013 | Sleiman | F01C 1/3446 123/235 |
| 8,951,027 | B2 * | 2/2015 | Petersen | F04C 2/344 418/144 |

(Continued)

FOREIGN PATENT DOCUMENTS

| | | | |
|---|---|---|---|
| CN | 102536801 | A | 7/2012 |
| CN | 103075339 | A | 5/2013 |
| DE | 2 316 529 | A1 | 10/1974 |

(Continued)

*Primary Examiner* — Mark Laurenzi
*Assistant Examiner* — Anthony Ayala Delgado
(74) *Attorney, Agent, or Firm* — McCormick, Paulding & Huber LLP

(57) ABSTRACT

The invention specifies a hydraulic vane-type machine (1) having a stator (2) and having a rotor (3) which has multiple vanes (4), each of which vanes is radially displaceable in a guide (5) in the rotor (3), bears against an inner circumference (6) of the stator (2), and, together with the rotor (3), the stator (2) and in each case one side wall (7) at each axial end of the rotor (3), delimits working chambers whose volumes vary in the event of a rotation of the rotor (3) relative to the stator (2). It is sought to obtain a certain degree of freedom for the design of the inner circumference. For this purpose, it is provided that each vane (4) has, on its radially inner side, an abutment surface (17) which bears radially at the outside against a cam disk (15).

14 Claims, 3 Drawing Sheets

(56) References Cited

U.S. PATENT DOCUMENTS

2013/0251571 A1* 9/2013 Iijima ..... F04C 2/00
418/28

FOREIGN PATENT DOCUMENTS

| | | | |
|---|---|---|---|
| DE | 3524275 | A1 | 4/1986 |
| DE | 101 09 572 | A1 | 10/2001 |
| FR | 1 315 068 | A | 1/1963 |

* cited by examiner

HYDRAULIC VANE-TYPE MACHINE

CROSS REFERENCE TO RELATED APPLICATIONS

Applicant hereby claims foreign priority benefits under U.S.C. § 119 from European Patent Application No. EP 14193256 filed on Nov. 14, 2014, the contents of which are incorporated by reference herein.

TECHNICAL FIELD

The invention relates to a hydraulic vane-type machine having a stator and having a rotor which has multiple vanes, each of which vanes is radially displaceable in a guide in the rotor, bears against an inner circumference of the stator, and, together with the rotor, the stator and in each case one side wall at each axial end of the rotor, delimits working chambers whose volumes vary in the event of a rotation of the rotor relative to the stator.

BACKGROUND

A vane-type machine of said type is known from U.S. Pat. No. 6,684,847 B1. The vanes are equipped, on both axial ends, with projections which are each guided in grooves provided in the stator. The profile of the grooves determines the movement of the vanes.

A vane-type machine of said type may be used for example as a booster pump in a reverse osmosis installation, and then acts as a water-hydraulic machine. In a refinement that has been used up until now, the rotor is mounted eccentrically with respect to the inner circumference of the stator. Then, during one rotation, a point on the surface of the rotor approaches the inner circumference once, until a minimum spacing is reached, and then moves away from the inner circumference again, until a maximum spacing is reached. If the vane-type machine is used as a pump, then an outlet opening for the respective working chamber is provided in the region of the minimum spacing, from which working chamber water can then be discharged at an elevated pressure. If the vane-type machine is used as a motor, then a feed or supply port is situated in said region, at which feed or supply port water can be fed in under pressure.

In the case of a vane-type machine of said type, it has hitherto always been the case that an even number of vanes has been used, and a spacer has been installed between vanes which are situated diametrically opposite one another, such that two mutually diametrically oppositely situated vanes have always described precisely one diameter. However, such a solution is possible only in the case of machines in which the inner circumference of the stator has a cylindrical shape.

SUMMARY

The invention is based on the object of obtaining a certain degree of freedom for the design of the inner circumference.

Said object is achieved, in the case of a hydraulic vane-type machine of the type mentioned in the introduction, in that each vane has, on its radially inner side, an abutment surface which bears radially at the outside against the cam disc.

In the case of such a design, there is no longer a reliance on the inner circumference having the same diameter for every angular position of the rotor. Rather, fluctuating diameters may be used here. The movement of a vane no longer needs to correlate with the movement of a vane situated diametrically opposite. Accordingly, it is also possible to use an odd number of vanes. The use of a cam disc, against the outer circumference of which the abutment surfaces of the vanes bear, makes it possible for the vanes to be guided with a relatively large degree of freedom. The vanes are pushed radially outward by the cam disc. The movement radially inward may be effected by the inner circumference of the stator. Such a machine may also be operated with water as hydraulic liquid, and then forms a water-hydraulic vane-type machine.

The abutment surface is preferably formed on at least one axial end of the vanes. It is thus possible for the cam disc to be arranged on an axial face side of the rotor, such that the construction of the rotor is not disrupted or impaired through the use of the cam disc.

The abutment surface is preferably formed in a recess on the axial end of the vane. The cam disc engages into said recess. It is thus possible for the cam disc to be overlapped by the vanes slightly in a radial direction.

In this case, it is preferable if the vanes protrude axially beyond the rotor. It is then possible for the cam disc to be arranged partially or even entirely axially outside the rotor, which has the advantage that the cam disc and the rotor do not disrupt one another.

The recess preferably has a radial extent which is greater than a maximum stroke of the vane. The cam disc is that overlapped by the vanes in the region of the recess over the entire stroke. The cam disc thus jointly serves for the axial sealing of the vanes, such that leakage can be prevented or at least minimized.

The recess preferably has an axial extent which corresponds to an axial thickness of the cam disc. In this case, it can be ensured that the vanes, outside the recess, bear by way of the axial end against the side wall and, within the recess, bear by way of their axial end against the cam disc. This yields, over the entire height of the vanes and in all angular positions of the rotor relative to the static parts, a sealing surface which extends over the entire radial length of the axial ends of the vanes. A relatively good sealing action can thereby be ensured.

The cam disc preferably corresponds to the inner circumference of the stator minus twice the radial extent of the vanes plus twice the radial extent of the recess. This is a relatively simple dimensioning rule. The cam disc can, so to speak, be designed as a smaller copy of the inner circumference of the stator.

The abutment surface is preferably rounded. Thus, friction between the vane and the cam disc is kept low. It is practically unavoidable that the vane will tilt in the guide. Even if said tilting can be kept very small, said tilting could give rise to problems. Such problems are reliably avoided by way of the rounding of the abutment surface.

In a preferred refinement, the rotor is mounted centrally relative to the stator, and a profile of a radial spacing between the stator and the rotor in a circumferential direction has at least two maxima and two minima. With such a design, at least two working cycles of the machine are realized per rotation of the rotor. There is no longer a reliance on mounting the rotor eccentrically with respect to the stator. Said design would permit only one working cycle.

The rotor preferably has a passage opening for receiving a shaft, which passage opening which widens in an axially inward direction toward a cavity. The cavity serves for reducing the mass of the rotor.

Here, it is preferable if the vanes protrude by way of their radially inner side into the cavity during an inward stroke. Then, the cavity is duly filled with water when the machine is operated. This is however not critical, because the pressure of the water in the cavity can be set to a mean value.

It is preferably provided that the vanes have a core composed of a steel and a lining composed of a plastic which interacts with low friction with steel. In this case, the rotor and the stator may be formed from steel. Since water does not exhibit any lubricating characteristics, the reduction in friction effected by a hydraulic oil in the case of an oil-hydraulic machine is in this case realized by the friction-reducing plastic. As plastic for the lining, use may be made in particular of materials from the group of high-strength thermoplastics materials based on polyaryletherketones, in particular polyether ether ketones, polyamides, polyacetylene, polyaryl ether, polyethylene terephthalates, polyphenylene sulphides, polysulfones, polyethersulfones, polyetherimides, polyamidimides, polyacrylates, phenol resins such as novolak resins or the like, wherein as filler materials, use may be made of glass, graphite, polytetrafluoroethylene or plastic, in particular in fibrous form. With the use of such materials, use may also be made of water as hydraulic liquid.

In this case, it is preferable if each vane has, in the region of the guide, a surface formed from a plastic which interacts with low friction with steel, and the abutment surface is at least partially formed from a steel, wherein the cam disc, at least in a region against which the abutment surface bears, has a surface which is formed from a plastic which interacts with low friction with steel. In this case, it can be achieved that a plastics—steel pairing always exists between moving parts. It is thus possible to avoid a plastics-plastics pairing over large contact regions, which at any rate would be disadvantageous with regard to the reduction in friction and with regard to wear.

The cam disc is preferably formed in one piece with the side plate. Said cam disc may for example be formed by a projection on the side plate.

In a preferred refinement, it is provided that at least one side wall has at least one opening which is delimited radially at the outside by a web against which the vanes bear. In the region of the opening, too, it is thus achieved that the vanes are supported in the axial direction radially at the inside and radially at the outside. Tilting of the vanes in a direction parallel to the axis of rotation can thus be reliably prevented.

BRIEF DESCRIPTION OF THE DRAWINGS

The invention will be described below on the basis of a preferred exemplary embodiment in conjunction with the drawing, in which.

DETAILED DESCRIPTION

Figure 1:
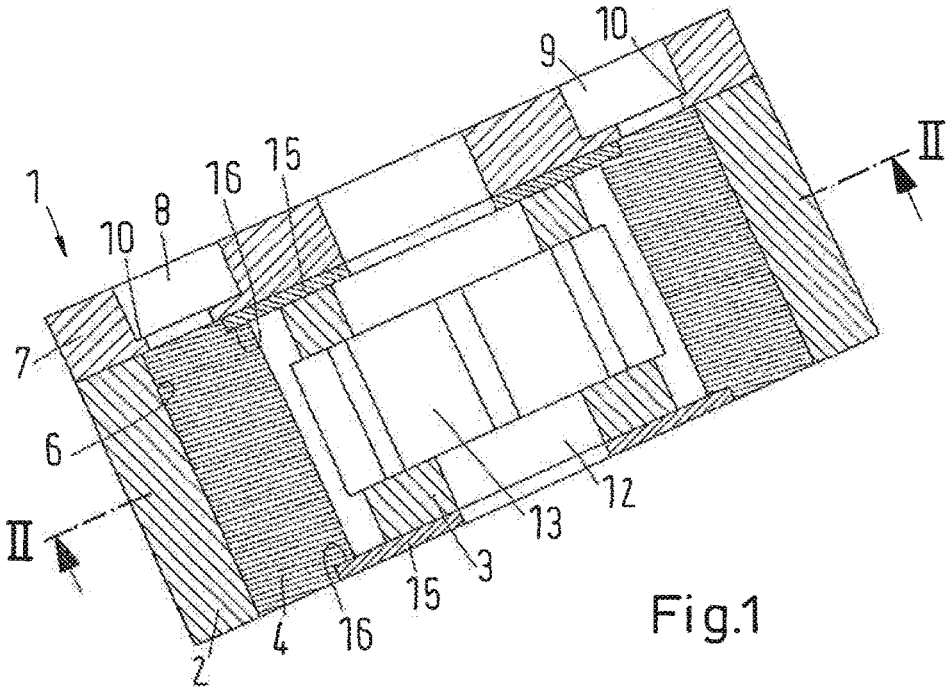
FIG. 1 is a sectional illustration I-I of a vane-type machine as per FIG. 2.

A vane-type machine 1 has a stator 2 and a rotor 3 which are mounted, so as to be rotatable relative to one another, by means which are not illustrated in any more detail. The rotor 3 has multiple vanes 4, each of which vanes is radially displaceable in a guide 5 in the rotor 3. The vanes 4 bear against an inner circumference 6 of the stator. On each axial end of the stator there is arranged a side wall 7. In the side wall 7 there may be provided openings 8, 9 which can be used for the supply and/or the discharge of water. FIG. 1 illustrates only one side wall 7. On the axially opposite face side, the stator 2 likewise has a side wall, which is however not illustrated. In said other side wall, it is possible under some circumstances for the openings 8, 9 to be omitted.

The openings 8, 9 extend radially outward, not quite as far as the stator 2. Rather, radially at the outside, webs 10, 11 are provided against which the vanes 4 can bear in an axial direction when the rotor rotates. Thus, the vanes are supported in the axial direction radially at the inside and radially at the outside even in the region of the openings 9, 10.

In the rotor 3 there is provided a passage opening 12 through which there can be guided, for example, a shaft by means of which the rotor 3 is mounted so as to be rotatable relative to the stator 2. Axially in the centre, the passage opening 12 widens to form a cavity 13. As can be seen in particular from FIG. 2, the vanes 4 protrude by way of their radially inner sides 14 into the cavity 13 when they are pushed radially inward by the inner circumference 6 of the stator 2.

On both axial face sides of the rotor 3, there is arranged in each case one cam disc 15. The cam disc 15 may be fastened to the side wall 7 or may be formed integrally with the side wall 7. Said cam disc has a shape which corresponds to the inner circumference 6 of the stator but in a smaller version, as will be discussed in more detail further below.

The vanes 4 each have, at both axial ends thereof, a recess 16. The cam disc 15 engages into said recess 16. Each recess 16 has an axial extent which corresponds to the axial thickness of the cam disc 15. The vanes 4 protrude axially beyond the rotor 3 by said axial extent, such that it is possible for the vanes 4 and the cam disc 15 to terminate flush with one another in an axial direction.

The recesses 16 may have an extent in the radial direction which is greater than a maximum stroke of the vane. The cam disc 15 then covers the vanes 4 in the region of the recess 16 over the entire radial stroke of said vanes.

Accordingly, a relatively simple rule as regards the design of the cam disc can be established. The inner circumference 6 of the stator is reduced by twice the radial extent of the vanes 4. Twice the radial extent of the recesses 16 is added thereto. With a cam disc 15 designed in this way, it is ensured that the vanes 4 always bear against the inner circumference of the stator 2 and ensure an adequate sealing action there.

At the axial ends, the vanes 4 bear by way of their face side either against the side wall 7 or against the cam disc 4, such that adequate sealing is provided there too. Sealing radially to the inside is realized by way of the interaction of the vanes 4 with the guides 5. It is naturally possible for small leakages to occur in all regions, because moving parts must be sealed relative to one another here. The leakages can however be kept relatively small.

Figure 2:
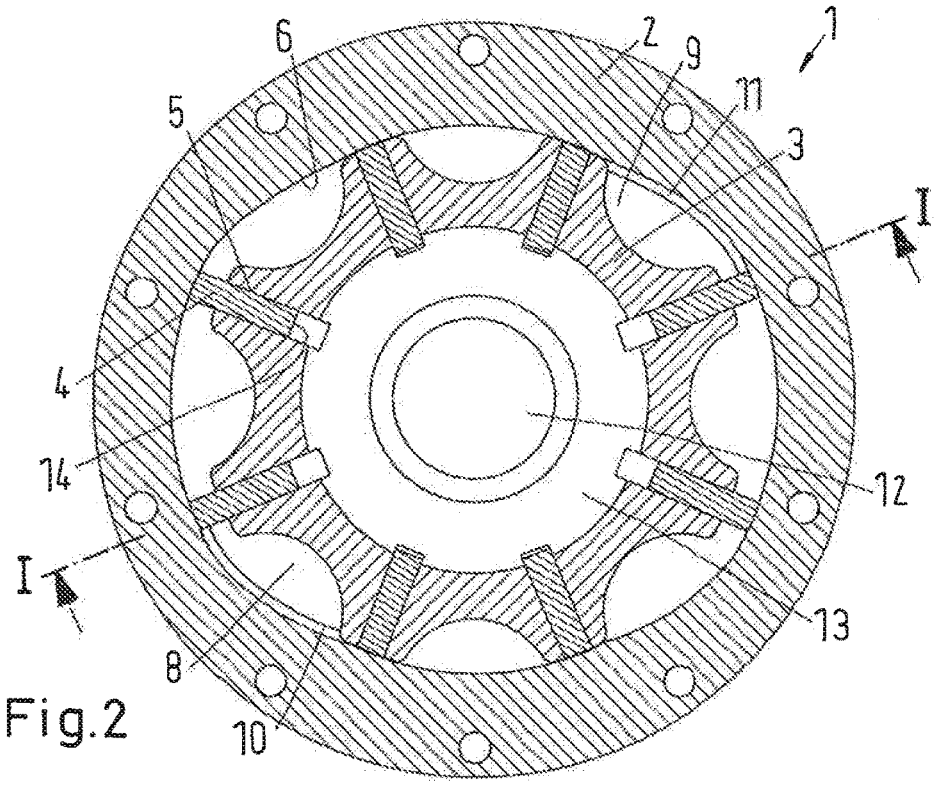
FIG. 2 is a sectional illustration I-I of the vane-type machine as per FIG. 1.

As can be seen in FIG. 2, the vane-type machine 1 illustrated there has two working cycles per rotation. With regard to the illustration in FIG. 2, a minimum spacing between the inner circumference 6 of the stator 2 and the rotor 3 is generated at points of the rotor 3 which point upward and downward, and a maximum spacing is generated at points which point to the left and to the right. Since a "delivery stroke" can be realized whenever the maximum spacing decreases toward the minimum spacing, it is the case that two working cycles are realized per rotation in the embodiment illustrated in FIG. 2. This possibility is realized by way of the cam disc 15.

Figure 3:
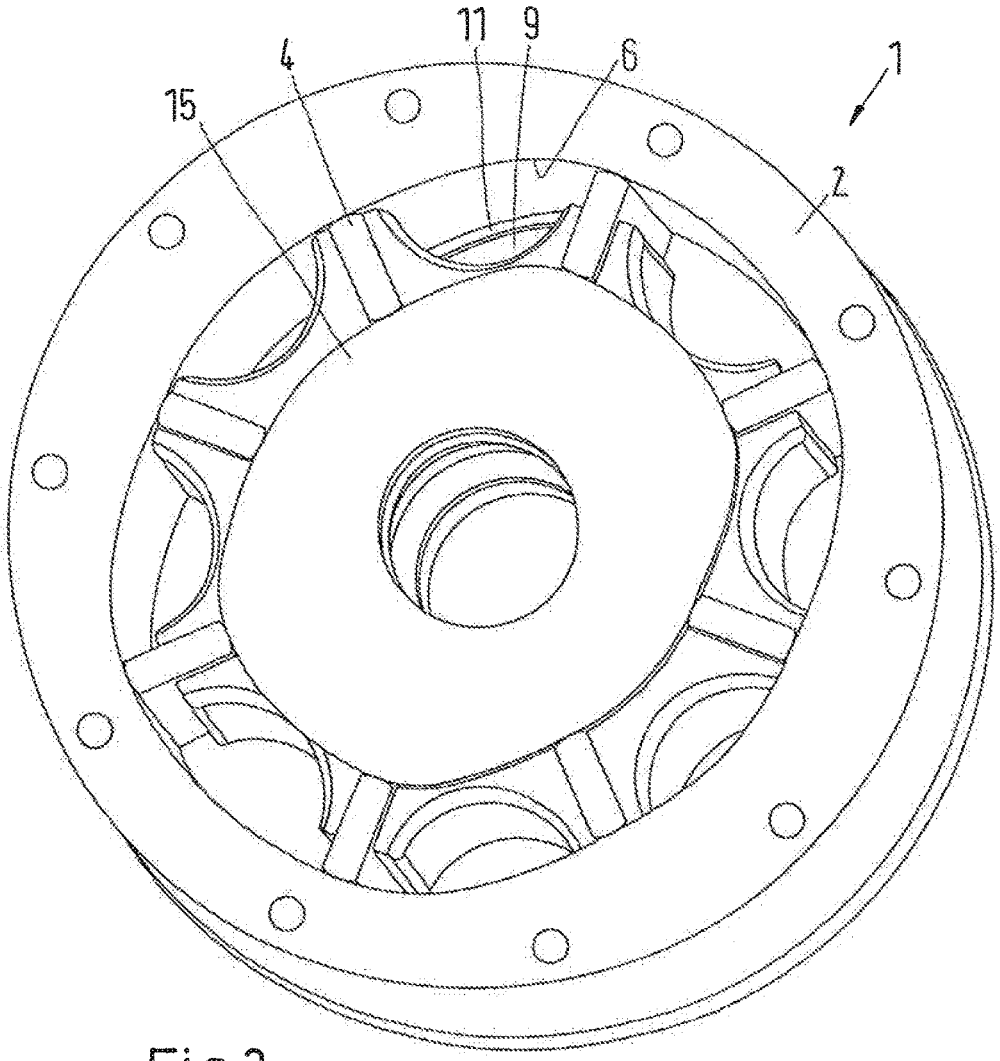
FIG. 3 is a perspective illustration of the vane-type machine without side wall.
Figure 4:
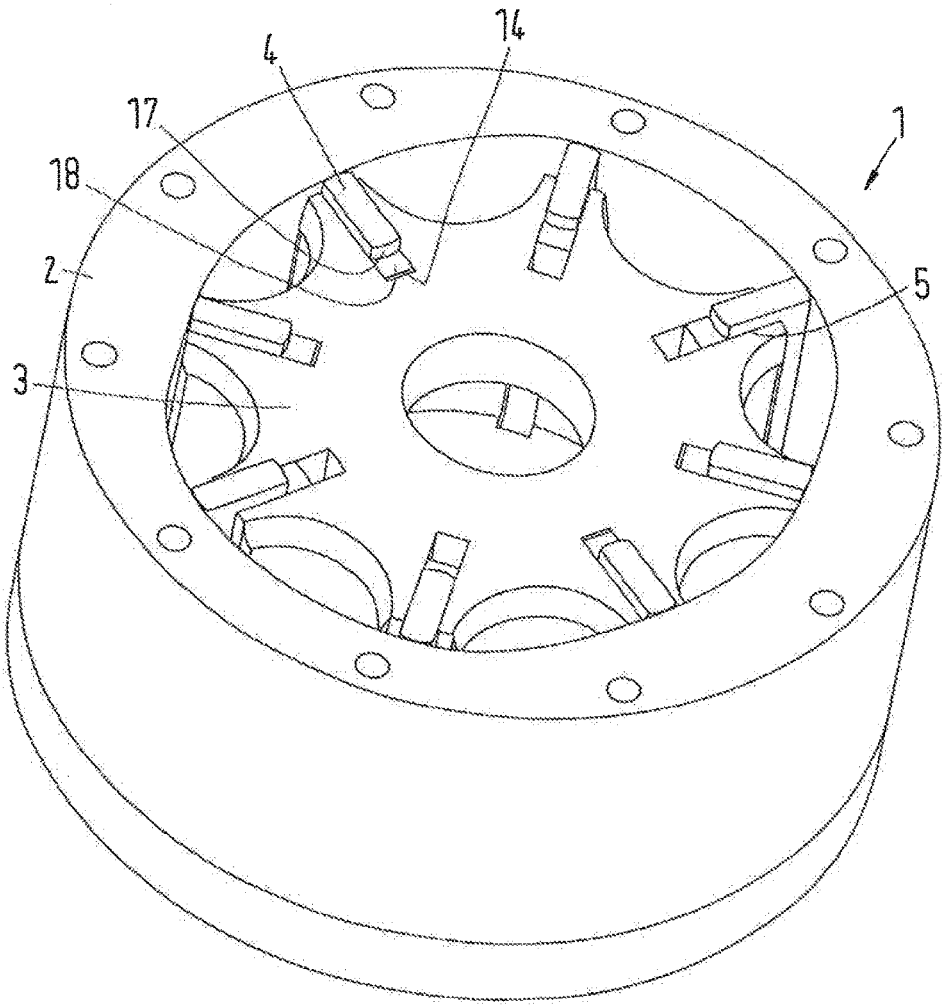
FIG. 4 is the illustration as per FIG. 3 without cam disc.

FIGS. 3 and 4 show the vane-type machine 1 in a perspective illustration. Identical parts are denoted by the same reference signs as in FIGS. 1 and 2.

From FIGS. 3 and 4, it can be seen somewhat more clearly that the radially inner sides of the vanes 4 are rounded in the region of the recesses 16 which form abutment surfaces 17 of the vanes 4, which abutment surfaces abut against the cam disc 15.

In this case, the cam disc 15 is formed as a separate element. It may however also be formed in one piece with the side wall 7.

If the cam disc 15 is formed as a separate element, its two face sides or pressure action surfaces on the two face sides, which may be defined for example by way of seals (not illustrated), can be dimensioned so as to yield force equilibrium across the rotor in an axial direction. In this way, a degree of play can be minimized, and correspondingly, leakage can be kept small.

The vanes 4 have a core composed of a steel and have a lining composed of a plastic which interacts with low friction with steel. Thus, the vanes 4 are designed such that they can interact with low friction with the stator 2 and with the guides 5 in the rotor 3. Reduced friction is also realized at the face sides of said vanes, which bear against the side wall 7 formed from steel. As plastics, use may be made in particular of materials from the group of high-strength thermoplastics materials based on polyaryletherketones, in particular polyether ether ketones, polyamides, polyacetylene, polyaryl ether, polyethylene terephthalates, polyphenylene sulphides, polysulfones, polyethersulfones, polyetherimides, polyamidimides, polyacrylates, phenol resins such as novolak resins or the like, wherein as filler materials, use may be made of glass, graphite, polytetrafluoroethylene or plastic, in particular in fibrous form. With the use of such materials, use may also be made of water as hydraulic liquid.

The cam disc 15 should expediently also be equipped with a corresponding plastic, at any rate in the region against which the rotor 3 bears by way of its face side.

To now prevent the vanes 4 bearing by way of a region coated with plastic against the cam disc 15 where the cam disc 15 is likewise coated with plastic, the recesses 6 are expediently milled out of the vanes 4 after the plastic has been applied. This yields, in the abutment region 17, a region which is formed at least partially from a steel and which then bears against the plastic of the cam disc 15. Owing to the rounded form of the abutment surface 17, it can also be achieved that contact between the plastic of the vane 4 and the plastic of the cam disc 15 can be practically prevented.

The vane 4 then also has a face-side surface 18 which is formed by the recess 6 which is likewise composed substantially of the steel of the core of the vane 4. Said surface 18 then bears axially against the cam disc 15, such that in this case, too, a plastics-plastics pairing is avoided, and a steel-plastics pairing is realized.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A hydraulic vane-type machine having a stator and having a rotor which has multiple vanes, each of which vanes is radially displaceable in a guide in the rotor, bears against an inner circumference of the stator, and, together with the rotor, the stator and in each case one side wall at each axial end of the rotor, delimits working chambers whose volumes vary in the event of a rotation of the rotor relative to the stator, wherein each vane has, on its radially inner side, an abutment surface which bears radially at the outside against a cam disk, wherein the abutment surface is formed on at least one axial end of the vanes, wherein the abutment surface is formed in a recess on the axial end of the vane, and wherein the recess has a radial extent which is greater than a maximum stroke of the vane.

2. The vane-type machine according to claim 1, wherein the vanes protrude axially beyond the rotor.

3. The vane-type machine according to claim 2, wherein the recess has a radial extent which is greater than a maximum stroke of the vane.

4. The vane-type machine according to claim 2, wherein the recess has an axial extent which corresponds to an axial thickness of the cam disk.

5. The vane-type machine according to claim 1, wherein the recess has an axial extent which corresponds to an axial thickness of the cam disk.

6. A hydraulic vane-type machine having a stator and having a rotor which has multiple vanes, each of which vanes is radially displaceable in a guide in the rotor, bears against an inner circumference of the stator, and, together with the rotor, the stator and in each case one side wall at each axial end of the rotor, delimits working chambers whose volumes vary in the event of a rotation of the rotor relative to the stator, wherein each vane has, on its radially inner side, an abutment surface which bears radially at the outside against a cam disk, wherein the abutment surface is formed on at least one axial end of the vanes, wherein the abutment surface is formed in a recess on the axial end of the vane, wherein the recess has a radial extent which is greater than a maximum stroke of the vane, and wherein the cam disk corresponds to the inner circumference of the stator minus twice the radial extent of the vanes plus twice the radial extent of the recess.

7. The vane-type machine according to claim 1, wherein the abutment surface is rounded.

8. The vane-type machine according to claim 1, wherein the rotor has a passage opening for receiving a shaft, which passage opening widens in an axially inward direction toward a cavity.

9. The vane-type machine according to claim 8, wherein the vanes protrude by way of their radially inner side into the cavity during an inward stroke.

10. The vane-type machine according to claim 1, wherein each vane has, in the region of the guide, a surface formed from a plastic that has a low-friction interaction with steel, and the abutment surface is at least partially formed from a steel, wherein the cam disk, at least in a region against which the vane bears, has a surface which is formed from a plastic that has a low-friction interaction with steel.

11. The vane-type machine according to claim 1, wherein the cam disk is formed in one piece with the side wall.

12. The vane-type machine according to claim 1, wherein the recess has an axial extent which corresponds to an axial thickness of the cam disk.

13. A hydraulic vane-type machine having a stator and having a rotor which has multiple vanes, each of which vanes is radially displaceable in a guide in the rotor, bears against an inner circumference of the stator, and, together with the rotor, the stator and in each case one side wall at each axial end of the rotor, delimits working chambers whose volumes vary in the event of a rotation of the rotor relative to the stator, wherein each vane has, on its radially inner side, an abutment surface which bears radially at the outside against a cam disk, wherein the abutment surface is formed on at least one axial end of the vanes, wherein the abutment surface is formed in a recess on the axial end of the vane, wherein the recess has an axial extent which corresponds to an axial thickness of the cam disk, and wherein the cam disk corresponds to the inner circumference of the stator minus twice the radial extent of the vanes plus twice the radial extent of the recess.

14. The-vane-type machine according to claim 1, wherein the vanes have a core composed of steel and a lining composed of plastic, and wherein the plastic interacts with a low friction with a steel material of the stator.

* * * * *